US009837184B2

(12) United States Patent
Juntermanns et al.

(10) Patent No.: US 9,837,184 B2
(45) Date of Patent: Dec. 5, 2017

(54) HIGH-VOLTAGE INSULATOR

(71) Applicant: SIEMENS AKTIENGESELLSCHAFT, Munich (DE)

(72) Inventors: Paul Juntermanns, Kerpen-Sindorf (DE); Achim Langens, Lohmar (DE)

(73) Assignee: Siemens Aktiengesellschaft, Munich (DE)

( * ) Notice: Subject to any disclaimer, the term of this patent is extended or adjusted under 35 U.S.C. 154(b) by 54 days.

(21) Appl. No.: 15/193,166

(22) Filed: Jun. 27, 2016

(65) Prior Publication Data

US 2016/0379736 A1 Dec. 29, 2016

(30) Foreign Application Priority Data

Jun. 26, 2015 (DE) ..... 10 2015 211 939

(51) Int. Cl.

| | |
|---|---|
| ***H01B 7/18*** | (2006.01) |
| ***H01F 27/04*** | (2006.01) |
| ***H01B 3/30*** | (2006.01) |
| ***H01B 17/26*** | (2006.01) |
| ***H01B 7/02*** | (2006.01) |
| ***H01B 3/12*** | (2006.01) |
| ***H01B 17/28*** | (2006.01) |
| ***H01B 17/32*** | (2006.01) |

(52) U.S. Cl.

CPC ..... *H01B 7/189* (2013.01); *H01B 3/12* (2013.01); *H01B 3/30* (2013.01); *H01B 7/0225* (2013.01); *H01B 17/26* (2013.01); *H01B 17/28* (2013.01); *H01B 17/32* (2013.01); *H01F 27/04* (2013.01)

(58) Field of Classification Search

CPC . H01B 7/189; H01B 3/12; H01B 3/30; H01B 17/26; H01B 17/34; H01B 17/56; H01B 17/58; H01B 17/583; H01F 27/04

See application file for complete search history.

(56) References Cited

U.S. PATENT DOCUMENTS

2007/0134963 A1* 6/2007 Janicke ..... H01B 17/54 439/188
2012/0292073 A1* 11/2012 Engels ..... H01B 17/28 174/73.1
2014/0076624 A1* 3/2014 Bohlin ..... H02G 15/046 174/40 R

FOREIGN PATENT DOCUMENTS

DE 2911402 A1 10/1980
DE 19644483 C1 11/1997

* cited by examiner

*Primary Examiner* — Hoa C Nguyen
*Assistant Examiner* — Amol Patel
(74) *Attorney, Agent, or Firm* — Laurence Greenberg; Werner Stemer; Ralph Locher

(57) ABSTRACT

A high-voltage insulator has an insulating body which is arranged around a high-voltage conductor. The high-voltage insulator has a damping chamber which at least partially engages around the insulating body and which is filled with an electrically insulating damping medium for damping an action of external mechanical force on the insulating body. A transformer bushing for routing a high-voltage conductor out of a transformer housing in an electrically insulating manner is further disclosed. The transformer bushing is characterized in that the transformer bushing contains a high-voltage insulator.

11 Claims, 2 Drawing Sheets

HIGH-VOLTAGE INSULATOR

CROSS-REFERENCE TO RELATED APPLICATION

This application claims the priority, under 35 U.S.C. §119, of German application DE 10 2015 211 939.4, filed Jun. 26, 2015; the prior application is herewith incorporated by reference in its entirety.

BACKGROUND OF THE INVENTION

Field of the Invention

The invention relates to a high-voltage insulator containing an insulating body which surrounds a high-voltage conductor.

High-voltage insulators of this kind are known from the prior art. In general, the high-voltage insulators have the task of insulating a high-voltage line, which is at high-voltage potential and usually contains the current-carrying high-voltage conductor, from a wall which is substantially at ground potential and through which the high-voltage line is intended to be routed. The high-voltage line is, for example, a high-voltage line which is routed out of a transformer housing, wherein the transformer housing is filled with an insulating liquid, for example oil. Furthermore, high-voltage insulators can, for example, also be used as high-voltage bushings in high-voltage direct-current transmission installations (HVDC transmission). In this case, high-voltage insulators have to have outstanding insulating capabilities because they usually have to insulate voltages of several hundred kilovolts. The insulating body usually surrounds an axial section of the high-voltage conductor and in this way prevents electrical flashovers between the high-voltage conductor and the wall.

In some applications, electrical installations and, in particular, high-voltage insulators which are used therein can be subjected to an action of mechanical force. The action of mechanical force may include both external environmental influences and, for example, impacts in the event of accidents with vehicle involvement or even being shot by firearms. Actions of force of this kind can damage the high-voltage insulator and/or the insulating body, with the result that the electrical insulating capability of the high-voltage insulator is impaired. As a result, the entire electrical installation in which the high-voltage insulator is used may break down under certain circumstances.

A further problem occurs in the case of transformer installations which contain oil-insulated transformers. Owing to an action of mechanical force, the insulating capability of the high-voltage insulator, which forms a transformer bushing in this connection, can be impaired in such a way that, owing to electrical flashovers, ignition of the insulating oil can lead to the entire transformer installation being set on fire.

SUMMARY OF THE INVENTION

The object of the invention is to propose a high-voltage insulator which is as insensitive as possible to the action of mechanical force.

In the case of a high-voltage insulator of this type, the object is achieved in that the high-voltage insulator has a damping chamber which at least partially engages around the insulating body and is filled with an electrically insulating damping medium for damping an action of external mechanical force on the insulating body.

Accordingly, the high-voltage insulator according to the invention provides additional protection against an action of mechanical force. If, for example, a mechanical force is exerted on the high-voltage insulator at specific points, this force can be damped by the damping medium and distributed over a larger area of action. In this way, any possible deformation of the insulating body can be avoided or at least reduced. A reduction in the insulating capability of the high-voltage insulator on account of the deformation of said high-voltage insulator can accordingly be minimized.

If the action of mechanical force involves being shot with a projectile, the projectile can be captured in the damping chamber before it reaches the insulating body. In this case, the damping medium at least partially absorbs the energy of the projectile. Although this may lead to damage to the high-voltage insulator, the projectile can be prevented from entering the insulating body. In the case of a transformer installation, the risk of ignition of the insulating oil directly by the projectile or indirectly by an electrical flashover can be reduced in this way.

According to one advantageous embodiment of the invention, the high-voltage insulator contains a first, inner tube and a second, outer tube which is at a distance from the first tube, which first tube and second tube are each arranged concentrically in relation to the high-voltage conductor and at least partially delimit the damping chamber. In this case, the damping chamber has a substantially cylindrical shape, wherein the cylinder which is delimited by the two concentric tubes engages around the insulating body. Owing to an action of external force on the high-voltage insulator at specific points, the outer of the two tubes deforms and absorbs a portion of the energy of the action of force under certain circumstances. The rest of the force can be at least partially, preferably completely, absorbed by the damping medium. The force which begins at specific points is advantageously distributed within the damping chamber, so that the force no longer acts at specific points, but rather over an area, on the inner of the two tubes. The risk of severe deformation or even rupture of the inner tube can be minimized in this way. The insulating body, which is shielded by the damping chamber, remains largely undamaged and largely maintains its insulating capability.

The first and the second tube can each extend axially along the entire high-voltage insulator, as a result of which the high-voltage insulator is comprehensively protected. Further insulation elements, such as silicone or ceramic shielding means for example, can be fitted radially on the outside of the high-voltage insulator. The insulation elements can be fitted, for example, to the outer of the two tubes.

The high-voltage insulator can further have fastening elements which are configured to fasten the high-voltage insulator to components of a high-voltage installation, for example a transformer or switchgear installation housing.

The first and/or the second tube are/is preferably composed of a plastic fiber composite material, a metal matrix composite material, a ceramic fiber composite material or a hard metal. These materials and the production of the materials are known per se to a person skilled in the art. The materials are particularly resistant to actions of mechanical force. Materials which are electrically insulating, such as plastics or ceramic, are particularly preferred.

It is considered to be advantageous when the damping medium has an electrical conductivity of less than 0.001 S/m (Siemens per meter), particularly preferably 0.0001 S/m. By way of example, some plastics, such as soft PVC, but also bulk materials or foams are suitable for this purpose.

According to one embodiment of the invention, the damping medium is a damping liquid. The damping medium has particularly favorable damping properties in this form.

The damping liquid may pass from the damping chamber to the outside due to correspondingly severe damage to the damping chamber. Therefore, it is generally advantageous when the damping liquid is relatively viscous. A viscosity of this kind can be achieved, for example, with silicone oils. The damping liquid advantageously has a viscosity of more than 103 Pa*s, particularly preferably more than 104 Pa*s, at room temperature.

The damping liquid is preferably a liquid of low flammability. A liquid is referred to as being of low flammability when the combustion point of the liquid is above 300° Celsius. Suitable damping liquids of low flammability are, for example, high molecular mass hydrocarbons, natural or synthetic esters or else the abovementioned silicone oils. The risk of the electrical installation in which the high-voltage insulator is used catching fire is minimized owing to the use of damping liquids of low flammability.

The damping medium can also be provided in the form of a solid. According to one exemplary embodiment of the invention, the damping medium is a dry foam. The dry foam has the advantage that, even when the damping chamber is damaged, the dry foam cannot pass to the outside and the functioning of the high-voltage insulator is generally not adversely affected even after an action of external force has taken place.

The dry foam is preferably a polyurethane foam (PUR foam). Furthermore, the dry foam can be foamed with an insulating gas, such as SF6 for example. This increases the insulating capability of the damping medium and therefore of the entire high-voltage insulator.

The insulating body preferably contains a winding body which is composed of electrically conductive inserts which are arranged concentrically around the high-voltage conductor and which are separated from one another by insulating layers, wherein the damping chamber is arranged radially on the outside of the winding body. The electrical inserts serve for electrical field control and are also called control inserts. Field control improves one of the insulating properties of the high-voltage insulator owing to a uniform distribution of the voltage drops between the high-voltage conductor and the wall.

The winding body preferably has a resin impregnation. To this end, the insulating body is impregnated with a resin, for example an epoxy resin. The insulating layers of the insulating body can contain, for example, paper, such as crêpe paper, or nonwoven material, wherein the insulating layers are wound onto a winding former, for example the high-voltage conductor, during the production process for the high-voltage bushing. The insulating body containing the wound-on insulating and control inserts is then impregnated in a resin or resin mixture, so that, after the resin composition has hardened, a compact block which does not contain any incorporated cavities is produced. Particularly good insulating properties of the high-voltage insulator can be achieved in this way.

A further object of the invention is to propose a transformer bushing for routing a high-voltage conductor out of a transformer housing in an electrically insulating manner, the transformer bushing being as insensitive as possible to an action of mechanical force.

The object is achieved in that the transformer bushing contains a high-voltage insulator according to the invention.

The advantages of the transformer bushing according to the invention can be gathered in a corresponding manner from the advantages produced above in connection with the high-voltage insulator according to the invention.

Other features which are considered as characteristic for the invention are set forth in the appended claims.

Although the invention is illustrated and described herein as embodied in a high-voltage insulator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
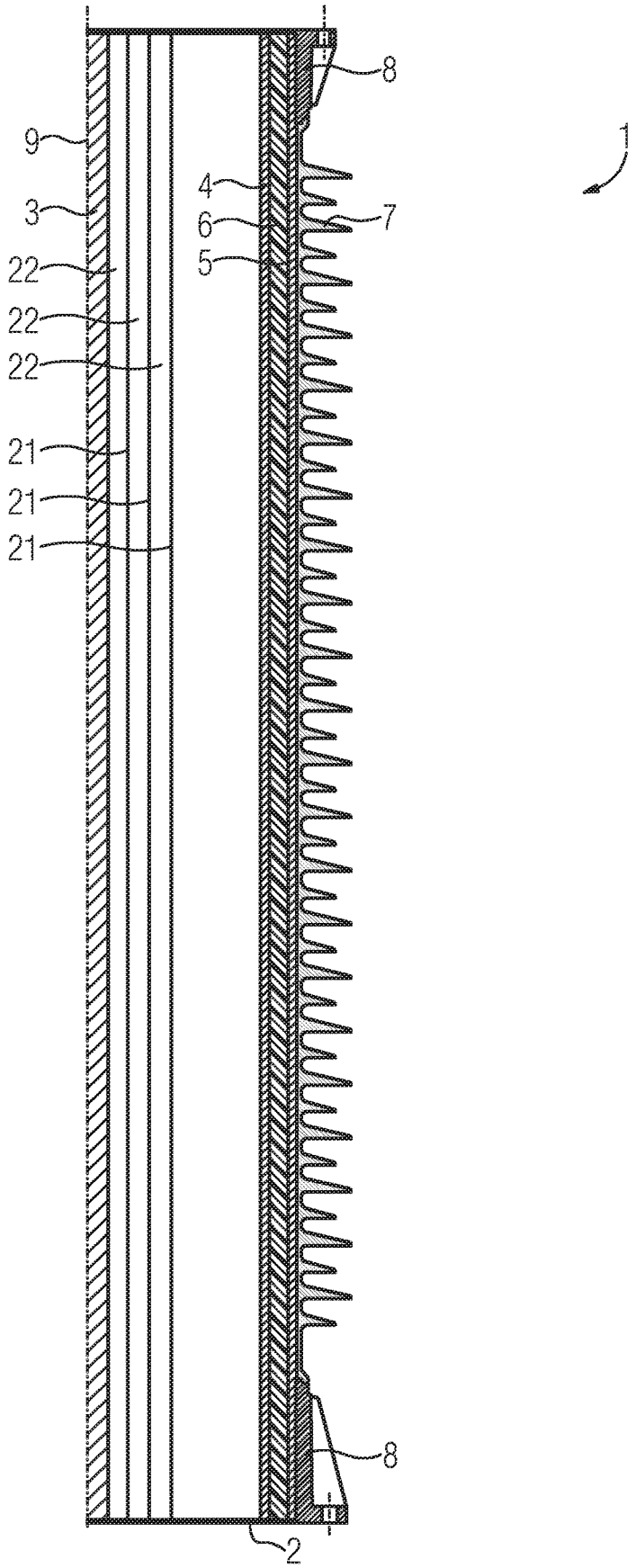
FIG. 1 is a diagrammatic, cross-sectional view through an exemplary embodiment of a high-voltage insulator according to the invention.

Referring now to the figures of the drawings in detail and first, particularly to FIG. 1 thereof, there is shown a cross-sectional view through a side of a high-voltage insulator 1. The high-voltage insulator 1 has an insulating body 2 which is arranged around a high-voltage conductor 3 and surrounds the high-voltage conductor on an axial length section. In the exemplary embodiment illustrated in FIG. 1, the high-voltage insulator 1 has cylinder symmetry. The axis of symmetry of the cylinder-symmetrical high-voltage insulator 1 is illustrated by a broken line 9.

The insulating body 2 contains control inserts 21 which are arranged concentrically around the high-voltage conductor 3, are composed of aluminum foil and are separated from one another by insulating layers 22 which are composed of resin-impregnated paper.

The high-voltage insulator 1 contains a first tube 4 and also a second tube 5 which is arranged at a distance from the first tube 4. The first tube 4 and the second tube 5 are each arranged concentrically around the high-voltage conductor 3. A hollow space which forms the damping chamber 6 is formed axially between the first tube 4 and the second tube 5. The damping chamber 6 is filled with a damping medium. In the exemplary embodiment illustrated in FIG. 1, the damping medium is a hard foam which is composed of polyurethane foam.

Plate-like insulating elements 7 which are formed from a silicone composite material are arranged radially on the outside of the high-voltage insulator 1. The high-voltage insulator 1 further contains fastening devices 8 which are designed to fasten the high-voltage insulator 1 to a wall. Since the fastening devices 8 are connected to a ground-connected wall, the fastening devices 8 are at ground potential. However, the high-voltage conductor 3 is at high-voltage potential, at 420 kV in the illustrated example.

An action of force on the high-voltage insulator 1 at specific points from outside the high-voltage insulator 1, for example owing to a projectile which is shot at the high-voltage insulator 1, initially deforms the second outer tube 5 at specific points. The projectile penetrates the second tube 5 and therefore enters the damping chamber 6. The energy of the projectile is absorbed by the damping medium in the damping chamber 6. Any remaining force of the projectile is distributed in the damping chamber or the damping medium in such a way that a pressure which is generated as a result is distributed over a larger area of the first tube 4. Severe deformation or even fracture of the first tube 4 can be prevented in this way. The insulating capability of the insulating body 2 is accordingly also maintained in the event of an action of external force at specific points.

Figure 2:
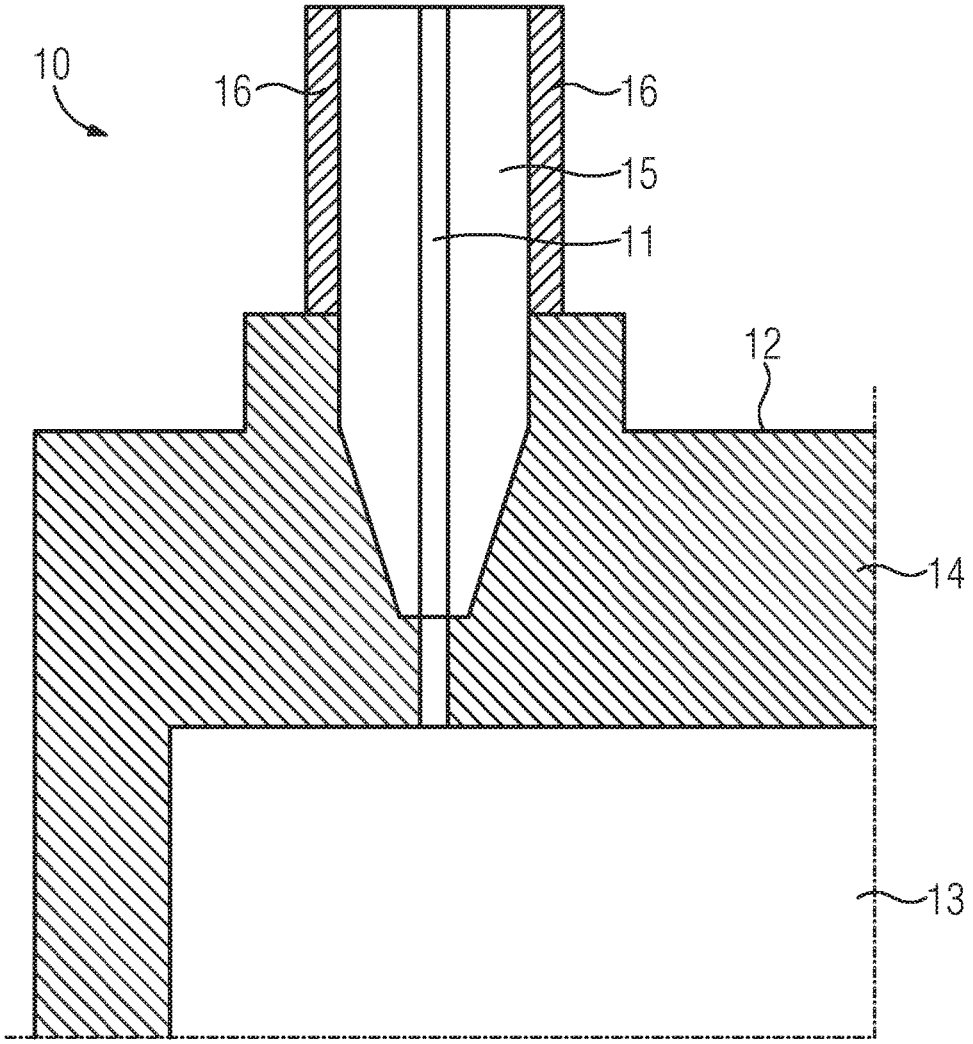
FIG. 2 is a diagrammatic, cross-sectional view through an exemplary embodiment of a transformer bushing according to the invention.

FIG. 2 shows an exemplary embodiment of a transformer bushing 10. The transformer bushing 10 is configured to route a high-voltage conductor 11, which is at high voltage, out of a transformer housing 12 of a power transformer 13.

The transformer bushing 10 shown in FIG. 2 provides an electrical transition from the transformer 13 to an outdoor high-voltage connection, not illustrated. The transformer bushing 10 extends from its high-voltage-side or transformer-side—in FIG. 2, lower—end, through a carrying flange, not illustrated, for fastening to the transformer housing 12, to the outdoor high-voltage connection.

In this case, the transformer housing 12 is filled with insulating oil 14. The transformer bushing 10 has an insulating body 15 which is arranged concentrically around the high-voltage conductor 11. A cylindrical damping chamber 16 is fitted to the outside of the insulating body 15. The damping chamber 16 extends in a longitudinal direction of the transformer bushing 10 from the wall of the transformer 13 up to an end, not illustrated in FIG. 2, of the transformer bushing 10, which end is remote from the transformer. Damage to the insulating body of the transformer bushing 10 can be prevented by the damping chamber 16 and the damping medium arranged therein in such a way that the risk of ignition of the insulating oil 14 is minimized.

The invention claimed is:

1. A high-voltage insulator, comprising:

an insulating body for surrounding a high-voltage conductor, said insulating body containing a winding body which is composed of insulating layers and electrically conductive inserts, said electrically conductive inserts being disposed concentrically around said high-voltage conductor and being separated from one another by said insulating layers;

an electrically insulating damping medium; and a damping chamber at least partially engaging around said insulating body and being filled with said electrically insulating damping medium for damping an action of external mechanical force on said insulating body, said damping chamber being disposed radially on an outside of said winding body.

2. The high-voltage insulator according to claim 1, further comprising:

a first tube; and a second tube being at a distance from said first tube, said first tube and said second tube are each disposed concentrically in relation to the high-voltage conductor and at least partially delimit said damping chamber.

3. The high-voltage insulator according to claim 2, wherein at least one of said first tube or said second tube is produced from a plastic fiber composite material, a metal matrix composite material, a ceramic fiber composite material or a hard metal.

4. The high-voltage insulator according to claim 1, wherein said electrically insulating damping medium has an electrical conductivity of less than 0.001 S/m.

5. The high-voltage insulator according to claim 1, wherein said electrically insulating damping medium is a damping liquid.

6. The high-voltage insulator according to claim 5, wherein said damping liquid is a liquid of low flammability.

7. The high-voltage insulator according to claim 1, wherein said electrically insulating damping medium is a dry foam.

8. The high-voltage insulator according to claim 7, wherein said dry foam is a polyurethane foam.

9. The high-voltage insulator according to claim 1, wherein said winding body has a resin impregnation.

10. A transformer bushing for routing a high-voltage conductor out of a transformer housing in an electrically insulating manner, the transformer bushing comprising a high-voltage insulator according to claim 1.

11. A high-voltage insulator, comprising:

a high-voltage conductor;

an insulating body surrounding said high-voltage conductor, said insulating body containing a winding body which is composed of insulating layers and electrically conductive inserts, said electrically conductive inserts being disposed concentrically around said high-voltage conductor and being separated from one another by said insulating layers;

an electrically insulating damping medium; and a damping chamber at least partially engaging around said insulating body and being filled with said electrically insulating damping medium for damping an action of external mechanical force on said insulating body, said damping chamber being disposed radially on an outside of said winding body.

* * * * *